US008398787B2

(12) United States Patent
Kariyazaki

(10) Patent No.: US 8,398,787 B2
(45) **Date of Patent: *Mar. 19, 2013**

(54) HIGH-STRENGTH STEEL SHEET EXCELLENT IN RESISTANCE TO STRESS-RELIEF ANNEALING AND LOW TEMPERATURE JOINT TOUGHNESS

(75) Inventor: Makoto Kariyazaki, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 176 days.

This patent is subject to a terminal disclaimer.

(21) Appl. No.: 12/867,856

(22) PCT Filed: Mar. 16, 2009

(86) PCT No.: PCT/JP2009/055050

§ 371 (c)(1),
(2), (4) Date: Aug. 16, 2010

(87) PCT Pub. No.: WO2009/119368

PCT Pub. Date: Oct. 1, 2009

(65) Prior Publication Data

US 2010/0322814 A1 Dec. 23, 2010

(30) Foreign Application Priority Data

Mar. 28, 2008 (JP) ..... 2008-088137

(51) Int. Cl.

| | |
|---|---|
| ***C22C 38/12*** | (2006.01) |
| ***C22C 38/14*** | (2006.01) |
| ***C22C 38/24*** | (2006.01) |
| ***C22C 38/26*** | (2006.01) |
| ***C22C 38/28*** | (2006.01) |

(52) U.S. Cl. ..... 148/335; 148/320; 148/332; 148/334; 148/336

(58) Field of Classification Search ..... 148/320, 148/334, 335, 332, 336, 648, 602; 420/126, 420/127, 109, 110, 111

See application file for complete search history.

(56) References Cited

U.S. PATENT DOCUMENTS 6,090,226 A * 7/2000 Hasegawa et al. ..... 148/320

(Continued)

FOREIGN PATENT DOCUMENTS

EP 1 516 938 A1 3/2005
EP 2 009 125 A1 12/2008

(Continued)

OTHER PUBLICATIONS

Machine-English translation of Japanese Patent No. 10-088231, Morikage Yasushi et al., Apr. 7, 1998.*

(Continued)

*Primary Examiner* — Deborah Yee

(74) *Attorney, Agent, or Firm* — Oblon, Spivak, McClelland, Maier & Neustadt, L.L.P.

(57) ABSTRACT

A high-strength steel sheet is provided which, even when subjected to long-term stress-relief annealing after welding, decreases little in strength and which has satisfactory low-temperature HAZ toughness. The high-strength steel sheet has a chemical composition adequately regulated and has a CP value defined by the following equation (1) of 5.40% or higher and a carbon equivalent (Ceq) defined by the following equation (2) of 0.45% or lower. CP value=125[Ti]+111[Nb]+60[V]+15[Mo] (1) ([Ti], [Nb], [V], and [Mo] indicate the contents (mass %) of Ti, Nb, V, and Mo, respectively.) Ceq=[C]+[Mn]/6+([Cr]+[Mo]+[V])/5+([Cu]+[Ni])/15 (2) ([C], [Mn], [Cr], [Mo], [V], [Cu], and [Ni] indicate the contents (mass %) of C, Mn, Cr, Mo, V, Cu, and Ni, respectively.

9 Claims, 1 Drawing Sheet

U.S. PATENT DOCUMENTS

| | | | |
|---|---|---|---|
| 2005/0230012 | A1 | 10/2005 | Usami et al. |
| 2008/0283158 | A1 | 11/2008 | Nagao et al. |
| 2009/0246067 | A1 | 10/2009 | Izumi et al. |
| 2010/0003161 | A1 | 1/2010 | Usami et al. |

FOREIGN PATENT DOCUMENTS

| | | | |
|---|---|---|---|
| EP | 2 105 516 | A1 | 9/2009 |
| JP | 57 116756 | | 7/1982 |
| JP | 57 120652 | | 7/1982 |
| JP | 2 270934 | | 11/1990 |
| JP | 2006 45672 | | 2/2006 |
| KR | 10-2005-0008832 | A | 1/2005 |
| KR | 10-2008-0023323 | A | 3/2008 |

OTHER PUBLICATIONS

Extended European Search Report issued May 30, 2011, in Application No. / Patent No. 09726030.1-2122 / 2258884 PCT/JP2009055050.

Office Action issued May 7, 2012, in Korean Patent Application No. 2010-7021458 with English and Japanese translations.

* cited by examiner

HIGH-STRENGTH STEEL SHEET EXCELLENT IN RESISTANCE TO STRESS-RELIEF ANNEALING AND LOW TEMPERATURE JOINT TOUGHNESS

TECHNICAL FIELD

The present invention relates to a high-strength steel sheet which, even when subjected to long-term stress-relief annealing (also referred to as "SR process") after welding, decreases little in strength, and which has excellent low temperature toughness in a heat affected zone (also referred to as "HAZ").

BACKGROUND ART

In recent years, manufacturers of large-scale steel pressure vessels (tanks) have been increasingly shifting the sites of assembly of tanks for overseas to the sites of use for the purpose of cost reduction. Heretofore, it has been a general practice to conduct cutting, bending and assembly (assembly by welding) of steel components, the SR process (local heat treatment) of some of the components, and the final assembly in the company's own factory, and then transport the entire tank to the site of use.

However, such contents of work have been changing to the following: for local construction considering efficiency, after only cutting and bending of steel components are carried out in the company's own factory, the materials are transported component by component; the tank is assembled at the site of use (assembly by welding); and the tank is subjected to SR treatment not locally but entirely.

As such a change progresses, because of the problem of the welding technique and from the perspective of safety, increasing the time and numbers of the SR treatment is required. Therefore, a material design which considers conducting the SR treatment for about 20 to 30 hours in total in consideration is required. There has been pointed out the problem that when the long-term SR treatment as described above is carried out, carbide in the steel is agglomerated and coarsened, whereby a reduction in the strength of the steel becomes noticeable.

The rolling method which is a combination of controlled rolling and controlled cooling is referred to as TMCP method, and is widely employed as a method which can provide a steel material having a low carbon equivalent and yet having high strength, high toughness, and high weldability (hereinafter referred to as "TMCP steel". In addition, the application of TMCP steel have been extended from the steel sheets for welded structures mainly including shipbuilding to the steel sheets for pressure vessels such as tanks. Even in the case of constructing pressure vessels and the like using such TMCP steel, the strength of the steel sheet may be greatly reduced when the long-term SR treatment as described above is carried out.

In order to cope with such situation, a means for imparting high strength is employed prior to conducting the SR treatment in general. However, to achieve high strength under severe conditions of the SR treatment, a large amount of alloy elements needs to be contained therein. As a result, HAZ toughness (in particular, low temperature toughness) of the welded structure is disadvantageously lowered.

Examples of the techniques for suppressing a reduction in strength by the SR treatment as much as possible include patent document 1 which suggests "tough hardened steel for pressure vessels" containing basically 0.26 to 0.75% of Cr and 0.45 to 0.60% of Mo. This technique is for suppressing the coarsening of carbide after the SR treatment by the addition of Cr, and for suppressing a reduction in the strength of the steel after the SR treatment. However, since such a steel material has a large amount of Cr contained, the problem of lowered low temperature toughness of the HAZ remains unsolved.

Patent document 2 suggests "high strength tough hardened steel for pressure vessels" containing basically 0.10 to 1.00% of Cr and 0.45 to 0.60% of Mo. This technique suppresses the reaction of $Fe_3C$ with coarse $M_{23}C_6$ by the long-term SR treatment by the addition of Cr. In this technique, the addition of Cr in a relatively wide range is anticipated, but actually only those containing Cr in an amount of 0.29% or higher are shown. It is therefore expected that the low temperature toughness of the HAZ is lowered.

Patent document 1: JP, S57-116756, A

Patent document 2: JP, S57-120652, A

DISCLOSURE OF THE INVENTION

Object to be Achieved by the Invention

The present invention was made in light of the above-mentioned circumstances, and its object is to provide a high-strength steel sheet which decreases little in strength even when subjected to long-term stress-relief annealing after welding (that is, resistance to stress-relief annealing is good), and has excellent low temperature toughness of HAZ (this characteristic is hereinafter referred to as "low temperature joint toughness" in the present invention).

Means for Solving the Problem

The high-strength steel sheet according to the present invention comprises C: 0.10 to 0.16% (by mass %. the same applies hereinafter), Si: 0.05 to 0.50%, Mn: 1.3 to 1.9%, Al: 0.01 to 0.05%, Ti: 0.005 to 0.025%, Nb: 0.005 to 0.025%, V: 0.005 to 0.06% and Mo: 0.03 to 0.10%, with the remainder being iron and inevitable impurities, a CP value defined by equation (1) below being 5.40% or higher, and a carbon equivalent Ceq defined by equation (2) below being 0.45% or lower.

$$CP\ \text{value}=125[\text{Ti}]+111[\text{Nb}]+60[\text{V}]+15[\text{Mo}] \quad (1)$$

However, [Ti], [Nb], [V] and [Mo] represent the amounts (mass %) of Ti, Nb, V and Mo contained, respectively.

$$Ceq=[\text{C}]+[\text{Mn}]/6+([\text{Cr}]+[\text{Mo}]+[\text{V}])/5+([\text{Cu}]+[\text{Ni}])/15 \quad (2)$$

However, [C], [Mn], [Cr], [Mo], [V], [Cu] and [Ni] represent the amounts (mass %) of C, Mn, Cr, Mo, V, Cu and Ni contained, respectively.

In the high-strength steel sheet of the present invention, it is useful to add, in addition to the above basic elements, if necessary, (a) Cr: 0.30% or lower (not including 0%), (b) Cu: 0.50% or lower (not including 0%) and/or Ni: 0.50% or lower (not including 0%), (c) Ca: 0.0040% or lower (not including 0%), among others, so that the characteristics of the steel sheet are further improved depending on the kind of the components contained.

Effect of the Invention

According to the present invention, by controlling the chemical composition of the steel sheet in such a manner that the CP value and carbon equivalent Ceq represented by equation (1) and equation (2) above, respectively, satisfy defined ranges, a reduction in strength of the steel sheet after the SR treatment can be suppressed and excellent low temperature joint characteristic can be achieved. Such a high-strength steel sheet is extremely useful as a material for manufacturing tanks (pressure vessels) and the like where severe SR treatment is carried out.

BEST MODE FOR CARRYING OUT THE INVENTION

Figure 1:
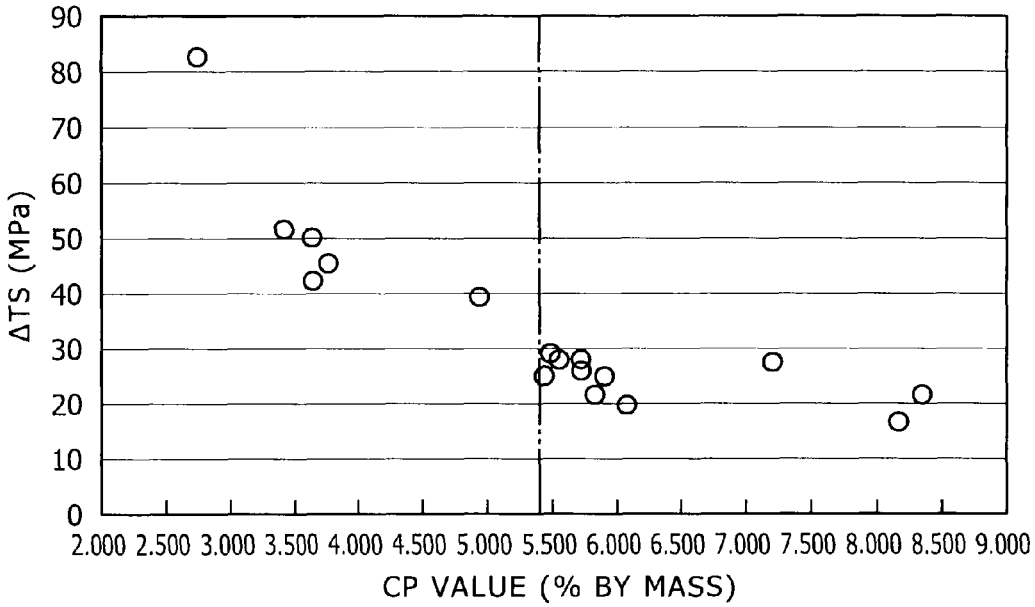
FIG. 1 is a graph which shows the relationship between CP value and reduction in strength ΔTS.

The inventors of the present invention contemplated the realization of a steel material having strength which is not lowered even when subjected to long-term SR treatment and good low temperature joint toughness from various angles. As a result, a steel sheet whose chemical composition is strictly controlled achieves the above object successfully, accomplishing the present invention. The constitution, actions and effects of the present invention will be described along with the history of the accomplishment of the present invention.

The inventors of the present invention thought that reduction in the strength of the steel sheet resulted from a change of the state of C. In the steel sheet, C exists as a solid solution, minute carbide deposits, or cementite ($Fe_3C$). It is thought that dissolved carbon and minute carbide deposits contribute to the improvement of strength of the steel sheet, but cementite little contributes to strength because it is coarse. That is, diffusion of C into cementite caused by the SR treatment increases the fraction of the cementite phases (hereinafter referred to simply as "cementite fraction"), and the contribution of C to strength is lost.

As for a steel subjected to normal reheating quenching and tempering (hereinafter referred to as "QT steel"), there exists a technique for suppressing a reduction in strength by suppressing cementite coarsening during the SR treatment. However, cementite fraction reaches its limit by such a technique due to tempering treatment, and therefore the technique for suppressing cementite fraction cannot be applied. Accordingly, it is necessary to manufacture a steel sheet by TMCP method in which the steel sheet after being rolled is supercooled by quenching to maintain C in the solid solution state and suppress the generation of cementite as much as possible, so that at least the cementite fraction prior to the SR treatment is kept low. However, the cementite fraction of the known TMCP steel tends to be increased due to the SR treatment even by suppressing generation of cementite as described above.

To this end, the inventors of the present invention conceived the idea of suppressing the generation of cementite in the TMCP steel during the SR treatment for the purpose of utilizing C to ensure the strength of the steel sheet after the SR treatment. Based on such an idea, the inventors conducted further research on the influence of the chemical components on the strength of the steel sheet after the SR treatment.

As a result, it was found that low temperature joint toughness can be ensured even in a low alloy component system, and the generation of cementite during the SR treatment at a high temperature for a long period of time can be suppressed. Therefore, they realized a high-strength steel sheet in which sufficient strength can be ensured after the SR treatment by strictly defining the chemical composition as described above, and a reduction in low temperature joint toughness is not caused.

The SR treatment is a heat treatment conducted at high temperatures of 586 to 625° C. for about 20 to 30 hours. Under such severe conditions, however, many deposits are dissolved, and C diffuses in cementite. However, it is presumed by using a general thermodynamic software (available from "Thermo-Calc", CRC Research Institute, Inc.) that Ti, Nb, V and Mo control the diffusion of C and suppress a cementite fraction by, for example, forming stable deposits of compositions such as TiC, $Nb_2C$, $V_2C$ and $Mo_2C$, even during the SR treatment.

To this end, the inventors of the present invention calculated the amount of deposits in a thermal equilibrium state by the above Thermo-Calc to determine the proportion of deposits formed (that is, the contribution of carbon to suppressing diffusion), and further made correction to match it with a nonequilibrium state, whereby the CP value defined by equation (1) below was determined as a diffusion parameter of C. In addition, it was found that if this CP value is 5.40% or higher, diffusion of C into cementite can be suppressed. However, any of the elements prevents weldability when contained in an excessive amount, and therefore its upper limit naturally exists (described later).

$$CP\ \text{value}=125[\text{Ti}]+111[\text{Nb}]+60[\text{V}]+15[\text{Mo}] \quad (1)$$

wherein [Ti], [Nb], [V] and [Mo] represent the amount (mass %) of Ti, Nb, V and Mo contained, respectively.

In the steel sheet of the present invention, in order to maintain an excellent low temperature joint toughness, it is also necessary for the carbon equivalent Ceq defined by equation (2) below to be 0.45% or lower. This carbon equivalent Ceq is a value indicating the influence of each element on the low temperature joint toughness calculated as an amount of carbon contained, and is used in various fields (ASTM standard). The present invention uses such carbon equivalent Ceq as a criterion of judgment of the low temperature joint toughness. Equation (2) below also includes as members Cr, Cu, Ni and other elements, which are contained if necessary, in addition to the basic components (C, Mn, Mo and V) of the steel material. The amounts of Cr, Cu and Ni may be calculated considering their quantities only when these are contained.

$$Ceq=[\text{C}]+[\text{Mn}]/6+([\text{Cr}]+[\text{Mo}]+[\text{V}])/5+([\text{Cu}]+[\text{Ni}])/15 \quad (2)$$

wherein [C], [Mn], [Cr], [Mo], [V], [Cu] and [Ni] represent the amounts (mass %) of C, Mn, Cr, Mo, V, Cu and Ni contained, respectively.

In the steel sheet of the present invention, the CP value defined by equation (1) above is regulated to 5.40% or higher, and the carbon equivalent Ceq defined by carbon equation (2) above is regulated to 0.45% or lower, whereby good SR resistance and low temperature joint toughness after being subjected to the severe SR treatment are achieved. As for "severe SR treatment", not only its time duration but also its relationship with temperature need to be considered. In the present invention, as a scale to objectively determine the severe SR treatment, conditions under which the P value defined by equation (3) below becomes 18.8 or higher are anticipated. That is, in the steel sheet of the present invention, even when the SR treatment is carried out under such conditions that the P value defined by equation (3) below is 18.8 or higher, SR resistance and low temperature joint toughness are good.

$$P\ \text{value}=T(20+\log t_0) \quad (3)$$

wherein T: Heating temperature in SR treatment (K); and $t_0$: heating time in SR treatment (hour)

In the high-strength steel sheet of the present invention, the proportions of basic components such as C, Si, Mn, Al, Ti, Nb, Mo and V also need to be adjusted to fall within appropriate ranges. The reason why the ranges of these components are determined to such values is as follows:

[C: 0.10 to 0.16%]

C is an important element which improves the quenchability of the steel sheet, and ensures predetermined strength after SR treatment, but it deteriorates weldability when its amount contained is excessively high. Therefore, the amount needs to be 0.16% or lower. From the perspective of ensuring weldability, the lower the amount of C contained, the better. However, when the amount is lower than 0.10%, the strength of the steel sheet after the SR treatment cannot be ensured due to a reduction in quenchability. A preferable lower limit of the amount of C contained is 0.11%, while a preferable upper limit is 0.13%.

[Si: 0.05 to 0.50%]

Si acts as a deoxidizer in ingoting the steel and increases strength. In order to effectively produce such effects, Si needs to be contained in an amount of 0.05% or higher. However, when the amount of Si contained is excessively high, weldability is lowered. Therefore the amount needs to be 0.50% or lower. A preferable lower limit of the amount of Si contained is 0.20%, while a preferable upper limit is 0.40%.

[Mn: 1.3 to 1.9%]

Mn is an element which increases the strength of the steel sheet. In order to effectively produce such effects, Mn needs to be contained in an amount of 1.3% or higher. However, when the amount of Mn contained is excessively high, weldability is impaired. Therefore, the upper limit of its amount is 1.9%. A preferable lower limit of the amount of Mn contained is 1.45%, while a preferable upper limit is 1.60%.

[Al: 0.01 to 0.05%]

Al is added as a deoxidizer. When its amount is lower than 0.01%, sufficient effects are not produced, while when the amount contained is higher than 0.05%, cleanness in the steel sheet is suppressed. Therefore, the upper limit of its amount is 0.05%. A preferable lower limit of the amount of Al contained is 0.015%.

[Ti: 0.005 to 0.025%, Nb: 0.005 to 0.025%]

Ti and Nb have low solid solubility into cementite and high affinity for C. Thus, they are elements which suppress an increase in a cementite fraction and ensure the strength of the steel material after the SR treatment by forming the deposits (carbides) as mentioned above. In order to produce such effects, both elements need to be contained in an amount of 0.005% or higher. However, when the amounts of these elements contained are excessively high, their weldability is suppressed. Therefore, their amounts need to be 0.025% or lower. A preferable upper limit of the amount of Ti contained is 0.020%. A preferable lower limit of the amount of Nb contained is 0.010%.

[V: 0.005 to 0.06%, Mo: 0.03 to 0.10%]

Although V and Mo have strong affinity for C, they dissolve into cementite. However, its solid solubility into cementite is lowered when it is added in combination with Nb, forming V2C and Mo2C. These deposits are stably present even during the SR treatment, whereby an increase in a cementite fraction is suppressed. In order to produce such effects, the amounts of V and Mo contained need to be 0.005% or higher and 0.03% or higher, respectively. However, when the amounts of these elements contained are excessively high, their weldability is suppressed. Therefore, the amounts of V and Mo contained need to be 0.06% or lower and 0.10% or lower, respectively. A preferable lower limit of the amount of V contained is 0.020%, while its preferable upper limit is 0.050%.

The basic components in the high-strength steel sheet of the present invention are as mentioned above, and the remainder is iron and inevitable impurities. Examples of the inevitable impurities include raw materials of the steel or P, S, N, O and other elements which can get into the steel sheet during its manufacturing process. Among these impurities, P, S and N all lower the weldability and toughness of the steel sheet after being subjected to the SR treatment. Therefore, it is preferable that the amounts of P, S and N are kept to 0.020% or lower, 0.01% or lower, and 0.01%, respectively.

It is also useful to add to the steel sheet of the present invention, if necessary, (a) Cr: 0.30% or lower (not including 0%), (b) Cu: 0.50% or lower (not including 0%) and/or Ni: 0.50% or lower (not including 0%), and (c) Ca: 0.0040% or lower (not including 0%), among others. The characteristics of the steel sheet are further improved depending on the kind of the components contained. The reason why the ranges of the amounts of these elements are set is as follows:

[Cr: 0.30% or lower (not including 0%)]

Cr is an element effective in suppressing diffusion of C, but when it is contained in an excessively high amount, it impairs weldability. Therefore, its amount is desirably 0.30% or lower. A preferable amount of Cr contained in order to produce such effects is 0.10% or higher. When the amount is lower than this value, it will be treated as an inevitable impurity.

[Cu: 0.50% (not including 0%) and/or Ni: 0.50% or lower (not including 0%)]

These elements are effective in increasing the quenchability of the steel sheet. However, when they are contained in excessively high amounts, this effect is saturated. Therefore, they are both preferably contained in an amount of 0.50% or lower. In order to produce effects by these elements, they are both preferably contained in an amount of about 0.05% or higher. When the amounts are lower than this value, they will be treated as inevitable impurities.

[Ca: 0.0040% or lower (not including 0%)]

Ca is an element which is effective in improving the toughness of the steel sheet by controlling inclusions, but when it is contained in an excessively high amount, these effects are saturated. Therefore, the amount is preferably 0.0040% or lower. A preferable amount of Ca contained in order to produce such effects is 0.0005% or higher.

In the high-strength steel sheet of the present invention, when its chemical composition, the CP value represented by equations (1) and (2) above and the carbon equivalent Ceq satisfy the defined ranges, generation of cementite during the SR treatment is suppressed, whereby a reduction in strength of the steel sheet after being subjected to the SR treatment is prevented, and a reduction in joint toughness at a low temperature can be suppressed.

TMCP method is an application of "control of the state of austenite" conducted basically by rolling and "control of modification from the controlled austenite" successively performed. However, the present invention uses suppression of an increase in the cementite fraction to ensure the strength of the steel sheet. Therefore, it is preferable to roll the steel plate at a temperature not lower than the $Ar_3$ transformation point at which cementite does not deposit, maintain the diffusion of C in a solid solution state by controlled cooling after rolling, and suppress generation of cementite as much as possible. The conditions for manufacturing the steel sheet of the present invention may be selected according to a normal TMCP method except for the rolling temperature mentioned above.

EXAMPLES

The present invention will now be described in further detail with reference to the example, but it should be understood that the examples are not intended to limit the invention. Any modification in the range of the purpose described above or below can be made, which is within the technical scope of the present invention.

Steel ingots which were produced to have various chemical compositions shown in Table 1 below by the converter process and continuous casting were subjected to rolling with an exit temperature of not lower than the $Ar_3$ transformation point. The rolled steel sheets were subjected to accelerated cooling from that temperature (cooling rate: about 3 to 30° C./sec.), producing various steel sheets. Each of the obtained steel sheets was subjected to SR treatment (the P value represented by equation (3) above: 18.97) at 615° C. for 23 hours.

Table 1 shows the $Ar_3$ transformation point of the steel types, the values of which were determined based on equation (4) below (wherein [ ] represents the amount of each element contained (mass %); and t represents the thickness of the sheet (gage: mm)).

$$Ar_3=910-310[C]-80[Mn]-20[Cu]-15[Cr]-55[Ni]-80[Mo]+0.35(t-8) \quad (4)$$

[Tensile Test]

A test piece of ASTM A370-05 (0.500-in.Round Specimen) was collected from a position described as t/4 (t: thickness of sheet) of each of the steel sheets before and after the SR treatment in the direction perpendicular to the direction of rolling. Tensile test was carried out on the test pieces in the manner defined in ASTM A370-05 to measure their tensile strengths (TS). A reduction in strength (variation: ΔTS) was then measured by the difference between the tensile strengths before and after the SR treatment. Examples having this ΔTS value lower than 30 MPa and a tensile strength TS after being subjected to the SR treatment of 550 MPa or higher were evaluated to have good SR resistance.

These measurement results [tensile strength TS after being subjected to SR treatment (post-SR TS), reduction in strength ΔTS, HAZ toughness ($vE_{-46}$)] are shown in Table 2 below, along with the thicknesses of the steel sheets.

TABLE 1

| Experiment | Composition of chemical components* (% by mass, but ppm by mass for Ca and N) | | | | | | | | | | | | | | | CP value (% by | Carbon equivalent Ceq | $Ar_3$ |
|---|---|---|---|---|---|---|---|---|---|---|---|---|---|---|---|---|---|---|
| No | C | Si | Mn | P | S | Cu | Al | Ni | Cr | Mo | V | Nb | Ti | Ca | N | mass) | (% by mass) | (° C.) |
| 1 | 0.12 | 0.35 | 1.33 | 0.011 | 0.001 | 0.01 | 0.028 | 0.00 | 0.04 | 0.00 | 0.001 | 0.010 | 0.020 | — | 47 | 3.670 | 0.35 | 787 |
| 2 | 0.12 | 0.35 | 1.33 | 0.015 | 0.002 | 0.00 | 0.035 | 0.01 | 0.15 | 0.00 | 0.001 | 0.008 | 0.020 | — | 52 | 3.448 | 0.37 | 785 |
| 3 | 0.12 | 0.35 | 1.55 | 0.007 | 0.002 | 0.37 | 0.026 | 0.43 | 0.01 | 0.30 | 0.002 | 0.011 | 0.020 | — | 55 | 8.341 | 0.49 | 701 |
| 4 | 0.15 | 0.35 | 1.33 | 0.009 | 0.002 | 0.22 | 0.032 | 0.23 | 0.01 | 0.00 | 0.001 | 0.010 | 0.020 | — | 46 | 3.670 | 0.40 | 765 |
| 5 | 0.12 | 0.35 | 1.33 | 0.010 | 0.003 | 0.01 | 0.038 | 0.00 | 0.03 | 0.00 | 0.000 | 0.022 | 0.020 | — | 31 | 4.942 | 0.35 | 787 |
| 6 | 0.12 | 0.35 | 1.33 | 0.009 | 0.001 | 0.01 | 0.034 | 0.88 | 0.02 | 0.00 | 0.001 | 0.011 | 0.020 | — | 60 | 3.781 | 0.41 | 743 |
| 7 | 0.12 | 0.35 | 1.35 | 0.010 | 0.001 | 0.11 | 0.036 | 0.45 | 0.20 | 0.03 | 0.018 | 0.001 | 0.009 | 15 | 50 | 2.766 | 0.43 | 758 |
| 8 | 0.12 | 0.35 | 1.53 | 0.012 | 0.002 | 0.01 | 0.035 | 0.01 | 0.02 | 0.06 | 0.020 | 0.018 | 0.013 | — | 44 | 5.723 | 0.40 | 766 |
| 9 | 0.12 | 0.35 | 1.57 | 0.011 | 0.002 | 0.01 | 0.034 | 0.00 | 0.03 | 0.07 | 0.022 | 0.020 | 0.012 | — | 31 | 6.090 | 0.41 | 763 |
| 10 | 0.12 | 0.35 | 1.33 | 0.010 | 0.002 | 0.02 | 0.032 | 0.00 | 0.01 | 0.06 | 0.021 | 0.005 | 0.024 | — | 49 | 5.715 | 0.36 | 769 |
| 11 | 0.16 | 0.35 | 1.63 | 0.010 | 0.003 | 0.01 | 0.048 | 0.00 | 0.01 | 0.05 | 0.023 | 0.015 | 0.014 | — | 55 | 5.545 | 0.45 | 747 |
| 12 | 0.12 | 0.50 | 1.47 | 0.009 | 0.005 | 0 | 0.039 | 0.00 | 0.27 | 0.10 | 0.001 | 0.016 | 0.020 | 13 | 61 | 5.836 | 0.44 | 765 |
| 13 | 0.10 | 0.35 | 1.58 | 0.008 | 0.001 | 0.46 | 0.035 | 0.45 | 0.02 | 0.05 | 0.057 | 0.010 | 0.023 | — | 60 | 8.155 | 0.45 | 740 |
| 14 | 0.12 | 0.35 | 1.47 | 0.013 | 0.002 | 0.01 | 0.013 | 0.00 | 0.02 | 0.07 | 0.025 | 0.017 | 0.008 | — | 45 | 5.437 | 0.39 | 771 |
| 15 | 0.12 | 0.05 | 1.55 | 0.012 | 0.002 | 0.01 | 0.033 | 0.02 | 0.03 | 0.08 | 0.028 | 0.021 | 0.016 | 36 | 76 | 7.211 | 0.41 | 762 |
| 16 | 0.12 | 0.35 | 1.54 | 0.010 | 0.007 | 0.01 | 0.036 | 0.01 | 0.01 | 0.03 | 0.026 | 0.017 | 0.016 | — | 48 | 5.897 | 0.39 | 768 |
| 17 | 0.12 | 0.35 | 1.33 | 0.010 | 0.002 | 0.01 | 0.034 | 0.00 | 0.30 | 0.04 | 0.023 | 0.017 | 0.013 | — | 43 | 5.492 | 0.42 | 780 |
| 18 | 0.12 | 0.35 | 1.33 | 0.014 | 0.002 | 0.01 | 0.031 | 0.00 | 0.02 | 0.03 | 0.031 | 0.010 | 0.020 | — | 53 | 5.920 | 0.36 | 785 |

*Remainder: Iron and inevitable impurities

By using the steel sheets obtained in the manner described above, their low temperature joint toughnesses (HAZ toughness) were measured by the method described below, and their tensile strengths TS before and after the SR treatment were measured by the method described below to determine reductions in strength (ΔTS) before and after the SR treatment.

[Low Temperature Joint Toughness (HAZ Toughness)]

The steel sheets after being subjected to the SR treatment were subjected to cladding by welding by shielded metal arc welding with a welding heat input of 50 kJ/cm. A test piece of ASTM A370-05 was collected from a position described as t/4 (t: thickness of sheet) (at the center in width of HAZ) of each of the steel sheets in the direction perpendicular to the weld line to evaluate HAZ toughness. Charpy impact test were conducted at −46° C. according to ASTM A370-05 to measure absorbed energy ($vE_{-46}$). At this time, each of the steel sheets was measured for its absorbed energy ($vE_{-46}$) with three test pieces and their average was determined. Examples with the average value of $vE_{-46}$ of 55 J or higher were evaluated to have excellent HAZ toughness.

TABLE 2

| Experiment No. | Gage (mm) | Post-SR TS (MPa) | Reduction in strength ΔTS (MPa) | HAZ toughness ($vE_{46}$) (J) |
|---|---|---|---|---|
| 1 | 70 | 523 | 42 | 138 |
| 2 | 70 | 538 | 51 | 96 |
| 3 | 30 | 688 | 22 | 38 |
| 4 | 80 | 548 | 50 | 123 |
| 5 | 70 | 521 | 39 | 151 |
| 6 | 80 | 546 | 45 | 112 |
| 7 | 80 | 545 | 83 | 64 |
| 8 | 70 | 592 | 26 | 105 |
| 9 | 70 | 588 | 20 | 133 |
| 10 | 30 | 576 | 28 | 112 |
| 11 | 70 | 618 | 28 | 58 |
| 12 | 70 | 624 | 22 | 97 |
| 13 | 80 | 653 | 17 | 76 |
| 14 | 70 | 571 | 25 | 127 |
| 15 | 70 | 634 | 28 | 131 |
| 16 | 70 | 583 | 25 | 125 |
| 17 | 70 | 586 | 29 | 95 |
| 18 | 70 | 554 | 25 | 91 |

The following consideration can be derived from these results (Nos. below indicate Experiment Nos. in Table 2). Nos. 8 to 18 satisfy [chemical components, equations (1) and (2)] of the requirements defined in the present invention, and therefore they have small reductions in strength ΔTS and ensure predetermined tensile strengths TS even after severe SR treatment, and have good low temperature joint toughness (HAZ toughness).

On the contrary, Nos. 1 to 7 do not satisfy all of the requirements defined in the present invention, and any of their characteristics is deteriorated. Specifically, as for Nos. 1, 2 and 4 to 7 their CP values do not fall within the range defined in the present invention, whereby their reductions in strength ΔTS are increased and tensile strengths TS after being subjected to the SR treatment are lowered.

As for No. 3, its CP value satisfies the range defined in the present invention, and thus has a small reduction in strength ΔTS, but its carbon equivalent Ceq is beyond the range defined in the present invention, and its HAZ toughness is deteriorated.

Figure 2:
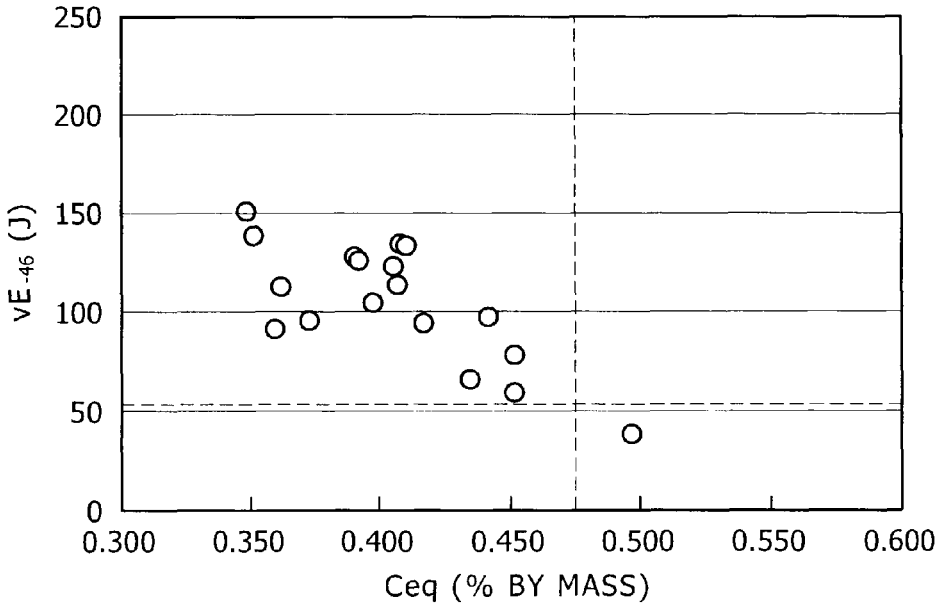
FIG. 2 is a graph which shows the relationship between carbon equivalent Ceq and HAZ toughness ($vE_{-46}$).

Based on these data, the relationship between the CP values and reductions in strength ΔTS is shown in FIG. 1, while the relationship between the carbon equivalents Ceq and HAZ toughnesses ($vE_{-46}$) is shown in FIG. 2. These results reveal that it is important to regulate the CP value to 5.40(%) or higher to minimize a reduction in strength ΔTS and the carbon equivalent to 0.45(%) or lower to ensure good HAZ toughness.

The invention claimed is:

1. A high-strength steel sheet which decreases little in strength after stress relieving annealing and has excellent low temperature joint toughness, the high-strength steel sheet comprising (hereafter % means mass %):

C: 0.10 to 0.16%,
Si: 0.05 to 0.50%,
Mn: 1.3 to 1.9%,
Al: 0.01 to 0.05%,
Ti: 0.005 to 0.025%,
Nb: 0.005 to 0.025%,
V: 0.005 to 0.06% and
Mo: 0.03 to 0.10%,
with the remainder being iron and inevitable impurities,
with a CP value defined by equation (1) below being 5.40% or higher, and
with a carbon equivalent Ceq defined by equation (2) below being 0.45% or lower;

$$CP\ \text{value}=125[Ti]+111[Nb]+60[V]+15[Mo] \quad (1)$$

wherein [Ti], [Nb], [V] and [Mo] represent the amounts of Ti, Nb, V and Mo contained (mass %), respectively;

$$Ceq=[C]+[Mn]/6+([Cr]+[Mo]+[V])/5+([Cu]+[Ni])/15 \quad (2)$$

wherein [C], [Mn], [Cr], [Mo], [V], [Cu] and [Ni] represent the amounts of C, Mn, Cr, Mo, V, Cu and Ni contained (mass %), respectively;

wherein the high-strength steel sheet has a change in tensile strength (ΔTS) value lower than 30 MPa and a tensile strength (TS) of 550 MPa or higher after being subjected to long term stress-relief annealing (SR) when the SR treatment is carried out under conditions such that the P value defined by equation (3) below is 18.8 or higher;

$$P\ \text{value}=T(20+\log t_0) \quad (3)$$

wherein T is the heating temperature (IC) in the SR treatment and $t_0$ is the heating time (hrs.) in the SR treatment; and wherein the steel sheet is obtained by rolling with an exit temperature of not lower than the $Ar_3$ transformation point.

2. A high-strength steel sheet according to claim 1, wherein the steel sheet further comprises, as another element, Cr: 0.30% or lower (not including 0%).

3. A high-strength steel sheet according to claim 1, wherein the steel sheet further comprises, as other elements, Cu: 0.50% or lower (not including 0%) and/or
Ni: 0.50% or lower (not including 0%).

4. A high-strength steel sheet according to claim 1, wherein the steel sheet further comprises, as another element, Ca: 0.0040% or lower (not including 0%).

5. A high-strength steel sheet according to claim 1, wherein the steel sheet has a tensile strength (TS) after being subjected to long term stress-relief annealing (SR) of 592 MPa or higher.

6. A high-strength steel sheet according to claim 1, wherein the steel sheet has a tensile strength (TS) after being subjected to long term stress-relief annealing (SR) of 618 MPa or higher.

7. A high-strength steel sheet according to claim 1, wherein the steel sheet has a CP value ranging from 5.437 to 8.155 mass %.

8. A high-strength steel sheet according to claim 1, wherein the steel sheet has a Ceq (carbon equivalent) ranging from 0.36 to 0.45 mass %.

9. A high-strength steel sheet according to claim 7, wherein the steel sheet has a Ceq (carbon equivalent) ranging from 0.36 to 0.45 mass %.

* * * * *